US008371794B2

(12) United States Patent
Magaldi

(10) Patent No.: US 8,371,794 B2
(45) Date of Patent: Feb. 12, 2013

(54) DRY MECHANICAL CONVEYOR PLANT FOR PYRITES AND COAL DUST

(75) Inventor: Mario Magaldi, Salerno (IT)

(73) Assignee: Magaldi Power S.p.A., Salerno (IT)

( * ) Notice: Subject to any disclaimer, the term of this patent is extended or adjusted under 35 U.S.C. 154(b) by 804 days.

(21) Appl. No.: 11/659,260

(22) PCT Filed: Aug. 1, 2005

(86) PCT No.: PCT/EP2005/008383

§ 371 (c)(1),
(2), (4) Date: May 24, 2007

(87) PCT Pub. No.: WO2006/013098

PCT Pub. Date: Feb. 9, 2006

(65) Prior Publication Data

US 2007/0297881 A1 Dec. 27, 2007

(30) Foreign Application Priority Data

Aug. 6, 2004 (IT) ..... MI2004A1632

(51) Int. Cl.
*B65G 65/00* (2006.01)

(52) U.S. Cl. ..... 414/291; 414/289; 414/133

(58) Field of Classification Search ..... 414/133, 414/327, 147, 148, 150, 157, 172, 209, 287, 414/288, 289, 291; 110/165 A, 165 R, 171, 110/185, 188, 193, 259, 341; 169/56, 60, 169/66, 37; 266/81; 198/502.1, 804, 836.1, 198/860.1, 860.3

See application file for complete search history.

(56) References Cited

U.S. PATENT DOCUMENTS

| | | | | | |
|---|---|---|---|---|---|
| 2,890,803 | A * | 6/1959 | Vanier et al. | ..... | 414/292 |
| 3,811,660 | A * | 5/1974 | Cole, Jr. | ..... | 261/18.1 |
| 3,912,015 | A * | 10/1975 | Garbee et al. | ..... | 169/61 |
| 4,025,057 | A * | 5/1977 | Shearer | ..... | 366/11 |
| 4,217,143 | A * | 8/1980 | Reich et al. | ..... | 106/757 |
| 4,267,889 | A * | 5/1981 | Williams | ..... | 169/61 |
| 4,388,110 | A * | 6/1983 | Jensfelt et al. | ..... | 75/629 |
| 4,641,789 | A * | 2/1987 | Moscardini | ..... | 241/31 |
| 5,119,877 | A * | 6/1992 | Sapko et al. | ..... | 169/61 |
| 5,255,615 | A * | 10/1993 | Magaldi | ..... | 110/234 |
| RE34,814 | E * | 1/1995 | Magaldi | ..... | 110/165 R |
| 5,385,104 | A * | 1/1995 | Binner | ..... | 110/246 |
| 6,230,633 | B1 * | 5/2001 | Magaldi et al. | ..... | 110/189 |
| 6,416,574 | B1 * | 7/2002 | Steelhammer et al. | ..... | 106/751 |
| 6,602,322 | B2 * | 8/2003 | McClelland, Jr. | ..... | 75/590 |
| 6,802,268 | B2 * | 10/2004 | Kroemmer et al. | ..... | 110/186 |

* cited by examiner

*Primary Examiner* — Saul Rodriguez
*Assistant Examiner* — Glenn Myers
(74) *Attorney, Agent, or Firm* — Olson & Cepuritis, Ltd.

(57) ABSTRACT

The present invention is about a conveyor plant for pyrites, other foreign materials like metal parts and occasionally ground solid fossil fuel, coming from the grinding mills of the solid fossil fuel, substantially comprising an open or enclosed metal container (1) inside which a metal conveyor belt (6) is disposed. The conveyor receives the material to be conveyed from the pyrites storage tanks (2) of each mill, through interception valves (3) and vibrating feeders (4) or directly from gravity discharge channels. Any spontaneous ignition of the conveyed material is controlled by a putting out system with water nozzles (17) or inert gas or steam admission nozzles (18) according to the plant configurations. The pyrites and the ground solid fossil fuel are collected in a stockage silo (16), it too provided with an inert gas or steam putting out system. For the storage tanks (2) a gas or steam inertization system is provided as well.

5 Claims, 9 Drawing Sheets

DRY MECHANICAL CONVEYOR PLANT FOR PYRITES AND COAL DUST

The present invention is about a conveyor plant for pyrites, mixed with other foreign materials and occasionally with coal dust coming from the mills for pulverizing solid fossil fuel, able to safely convey these hot materials flammable by spontaneous ignition.

Steam generators fed with solid fossil fuel, such as coal or lignite, require the fuel to be reduced at a predetermined fineness with the purpose to optimize the combustion in the boiler and to increase the energetic efficiency. The pulverization takes place in grinding plants where, by impacts, compression and friction of the mechanical members belonging to the mill grinding assembly, the coal is reduced to the desired granulometry. Then, the so obtained coal dust is conveyed to the boiler through pneumatic conveyors and burners.

In the prior art technique, the foreign and heavier materials present in the coal, such as pyrites, are ejected by centrifugal force from the mill grinding path and they are conveyed, together with a variable quantity of coal dust, to a storage area using hydraulic conveyor systems, in order to avoid the risk of fire or explosions for spontaneous ignition of the coal dust. The amount of coal dust is dependent from the kind of used mills, from the wear of the mechanical members forming the grinding assembly and from any malfunctioning.

The hydraulic systems, as well as uselessly consuming water and polluting it with the coal, have some limits in the conveyance of foreign metal pieces, normally present in the coal, and with the material size. To overcome these limits, grids at the entrance of the system for riddling the material are used, with consequent obstructions due to the need to manually clean said grids.

At present, vacuum pneumatic conveyors are also used, but they have a considerable limit consisting of the material size and the presence of iron pieces, which cause frequent obstructions.

Open rubber conveyor belts have been seldom used, collecting the pyrites from the mills, but, in case of spontaneous ignition of the coal, they can catch fire with flame spreading and catastrophic consequences.

The conveyor plant being object of the present invention removes the previously illustrated problems, since it provides for the use of a high temperature resistant metal conveyor belt able to convey the pyrites and the coal dust mixture with a minimum dust dispersion in the environment. The plant is provided with sensors able to detect any combustion and to activate a proper putting out system. The conveyor plant consists of an open or enclosed metal container in which a metal belt conveyor is installed, storage tanks positioned under the coal pulverization mills and a final stockage silo. The storage tanks which feed the metal belt conveyor have the purpose to isolate the coal pulverization mill from the downstream metal conveyor, during the loading and unloading operations. This separation is performed through a pair of valves upstream and downstream each storage tank.

The whole conveyor plant is provided with a fire prevention system to put out any combustion of the coal dust both on the metal conveyor belt and in the closed tanks. The combustion detection is performed through properly positioned sensors, which control the gas inertization for the closed areas and the water inertization for the conveyor belt. In case the conveyor belt is completely enclosed, the inertization can be performed with inert gas or steam.

The water fire prevention system is preferably positioned near the conveyor unloading point, in order to affect all the material conveyed to the stockage silo.

In case the conveyor is open, the metal belt is provided with restraining side boards to avoid the dust dispersion in the environment; the bottom of the metal conveyor is provided with openings, and a proper collecting channel of the putting out water is disposed beneath said conveyor.

In particular configurations of the conveyor plant, the metal conveyor can be provided with a fines recovery system, it too optionally provided with inertization nozzles, with water that can be conveyed to a proper collecting point by said recovery system.

The layout of the plant could provide, downstream the metal conveyor, for a pneumatic conveyor of the pyrite mixture to the stockage silo. In this embodiment an iron removal system, to eliminate the ferrous material present in the pyrites mixture, and a grinding system, to reduce the size of the pyrite mixture and to make it suitable for being pneumatically conveyed, are placed downstream the metal conveyor.

The innovative characteristics, objects and advantages of the present invention will be better highlighted in the following description and in the annexed drawings, illustrating embodiments given in a not limiting way, in which:

FIG. 1 is a schematic side view of the conveyor plant, wherein the conveyance to the stockage silo is exclusively mechanical;

FIG. 1*b* is a schematic side view of the conveyor plant, wherein the conveyance to the stockage silo is mechanical and pneumatic;

FIG. 2 is a schematic view of the metal conveyor belt provided with plates 9, screws 8, steel woven belt 7 and bearing rollers 10;

FIG. 3 is a schematic view of the metal conveyor belt showing the traction 12 and return 13 drums and the upper 10 and lower 11 bearing rollers;

Figure 6:
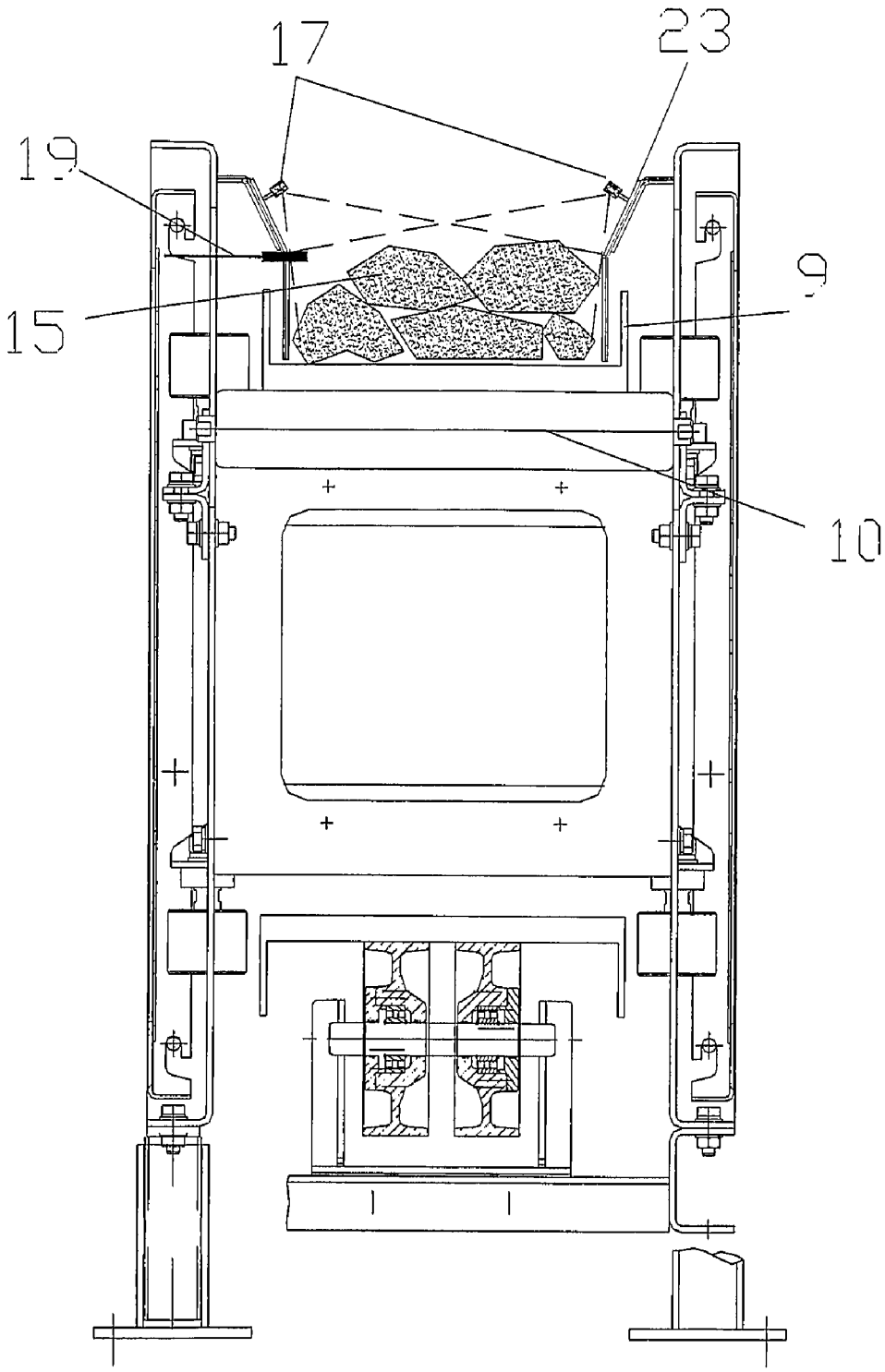
Figure 7:
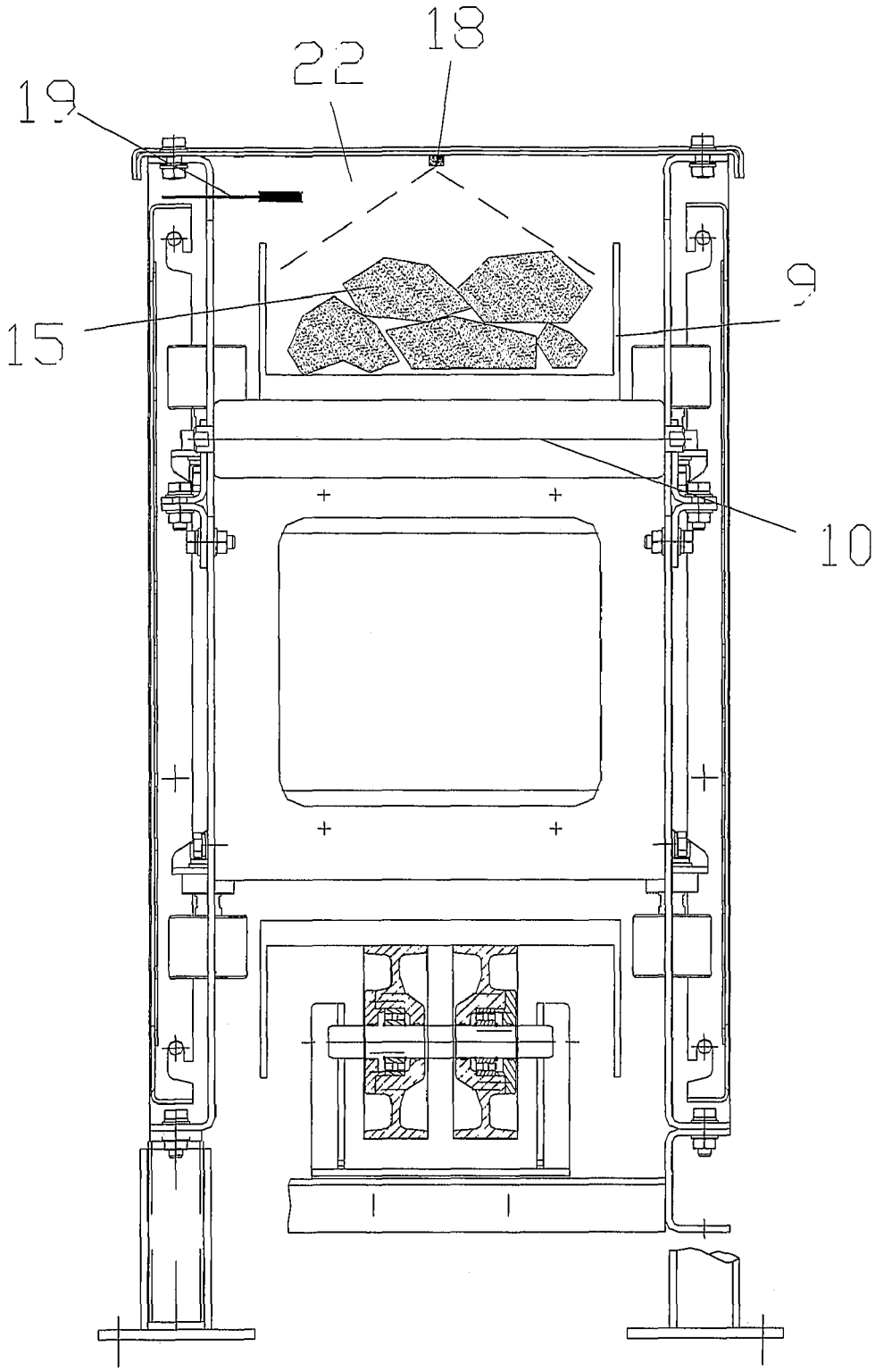
Figure 8:
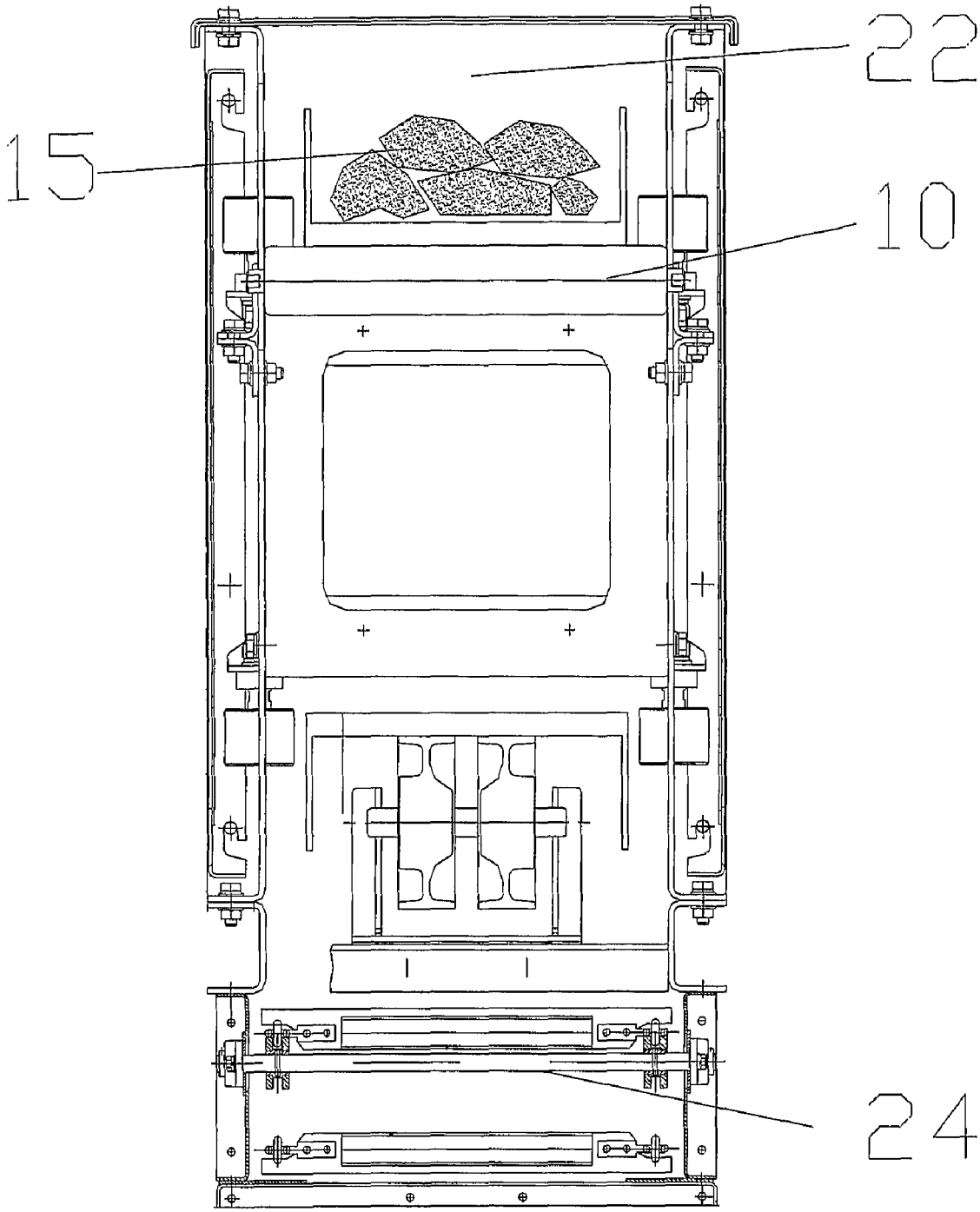
Figure 9:
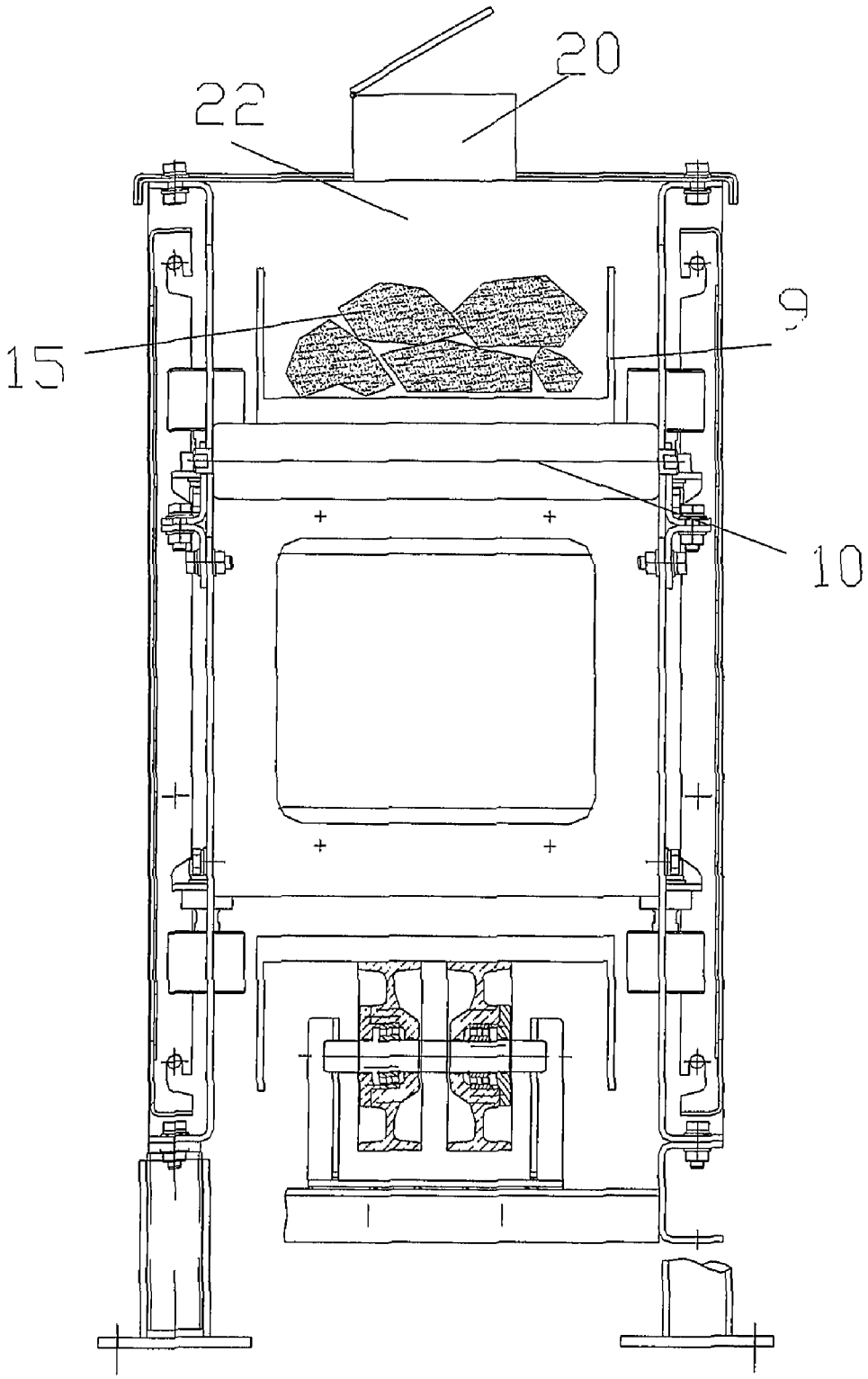

FIG. 6 is a schematic view in "a" configuration of the disposition of the fire prevention system nozzles 17 and the sensors 19 for controlling the combustible gas temperature and/or concentration on the conveyor belt 6;

FIG. 7 is a schematic view in "b" configuration of the disposition of the inert gas or steam adduction system nozzles 18 and the sensors 19 for controlling the combustible gas temperature and/or concentration inside the metal container 1;

FIG. 8 is a schematic cross sectional view of the conveyor provided with fines recovery system, in "b" configuration; and FIG. 9 is a schematic view of the explosion protection safety door 20 in case of "b" configuration metal conveyor.

It should be pointed out that the same reference numbers in the different Figures indicate the same or equivalent parts.

The present invention is related to a conveyor plant for pyrites, foreign materials like metal parts and occasionally ground coal, all coming from the fuel grinding mills used by power plants.

The metal belt handling element, made of steel and inserted into an open or enclosed metal container 1, essentially consists of a belt conveyor 6 comprising a belt 7 woven with a special steel, to which a set of mutually partially overlapping steel plates 10 is fastened through screws 8, forming a tight conveyor channel for the material. Said conveyor is supported by upper smooth rollers 10 and lower bearing rollers 11. The torque is transmitted by friction through a traction drum 12 and an opposite return drum 13, provided with a tensioning device 14.

Upon the application of the force exerted by the tensioning system 14, a pressure increase is obtained in the overlapping area of the plates 9, causing a better tight between the plates 9 which avoids losses of material, even of small size.

Alternatively, the steel conveyor suitable for conveying hot materials can also be of supporting plates type, with traction chains driven by sprockets.

The metal belt conveyor 6 receives the pyrites 15, coming from the storage tanks 2 downstream the mills (not shown in the drawings), when the interception valve 3 is opened and the interception valve 21 is closed. When the position of the two valves is inverted, the storage of the material in the tank 2 takes place.

The pyrites 15 collected in the storage tanks 2, outgoing from the interception valve 3, are loaded on the metal conveyor belt 6 through a proportioner 4.

The conveyor can have two different configurations:

"a" configuration—the metal container inside which the metal conveyor is installed is provided with openings that put in communication the interior of the container with the external environment;

"b" configuration—the metal container inside which the metal conveyor is installed is completely closed.

Figure 1:
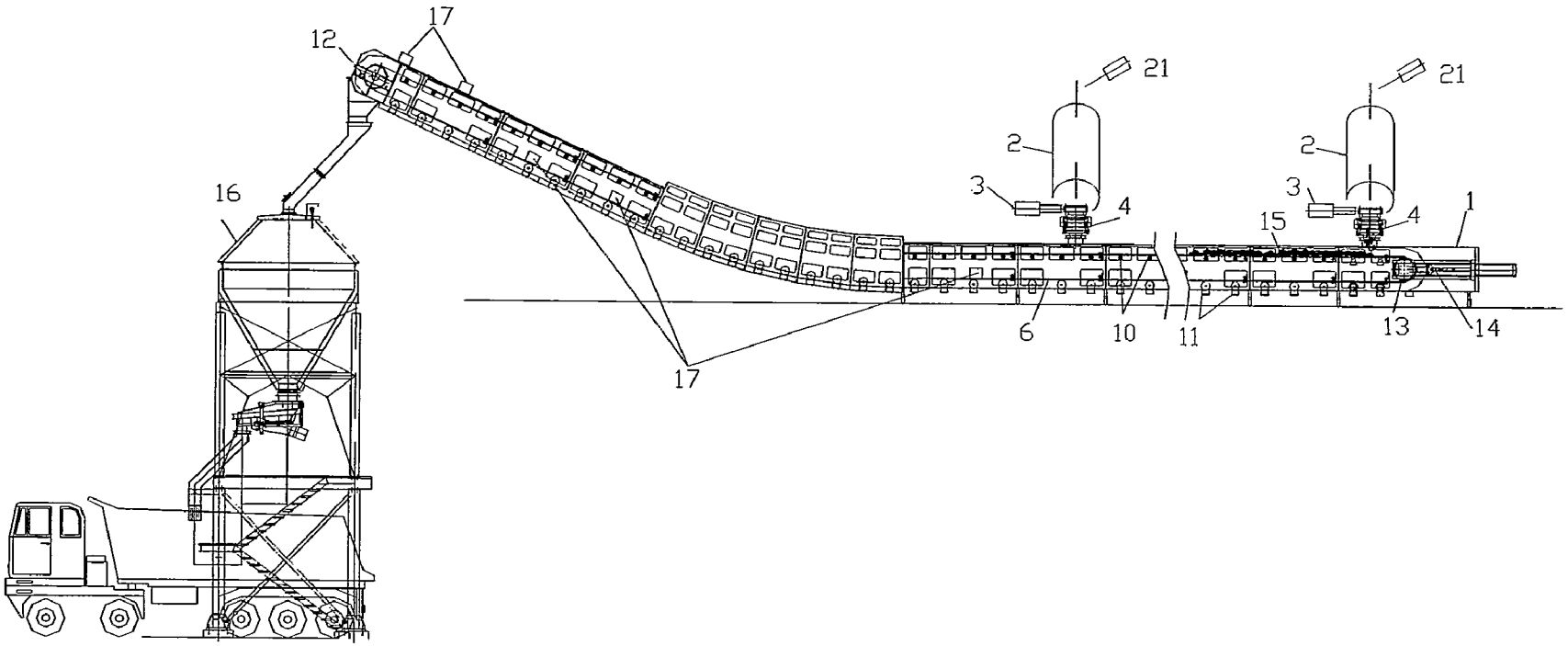
Figure 1B:
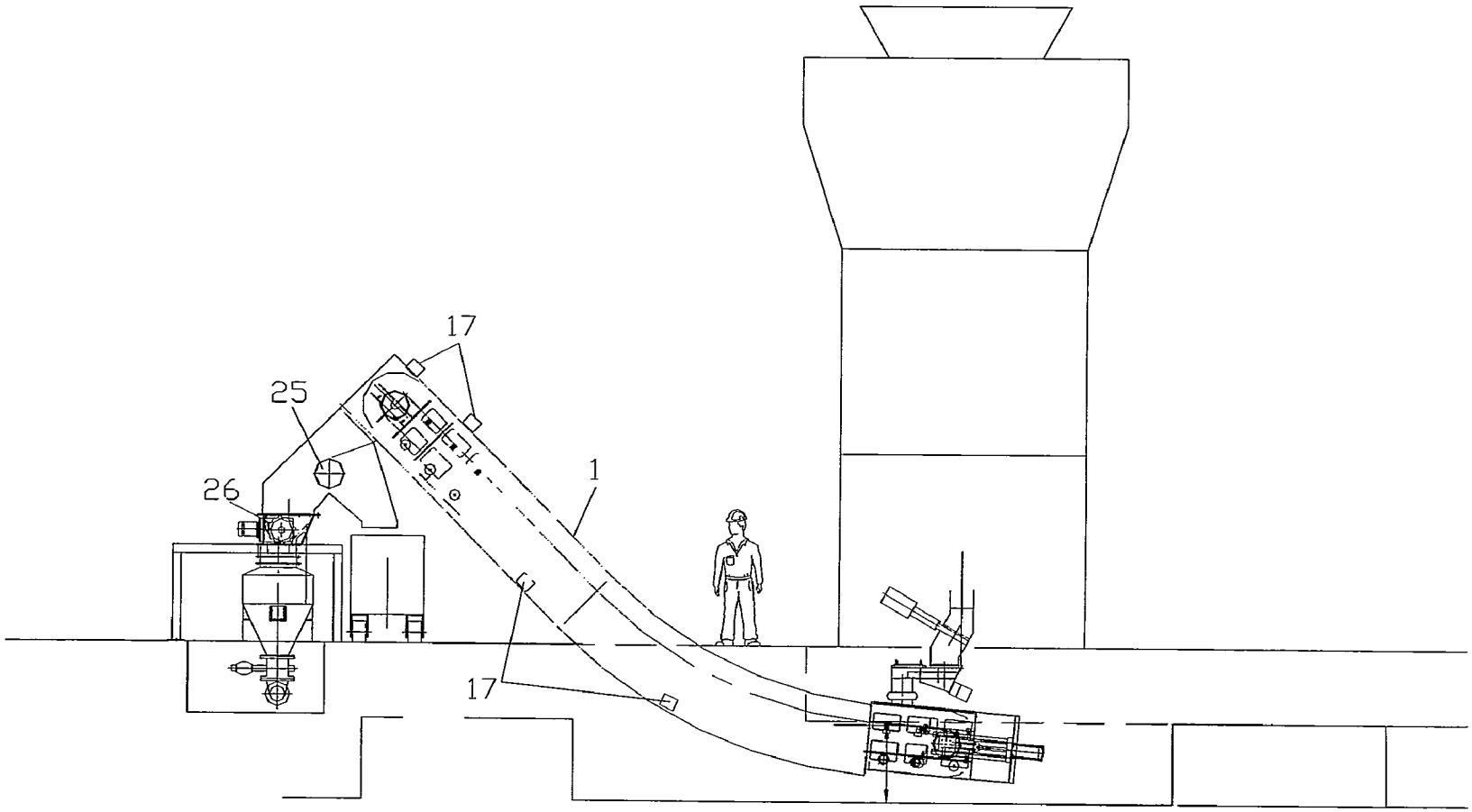
Figure 2:
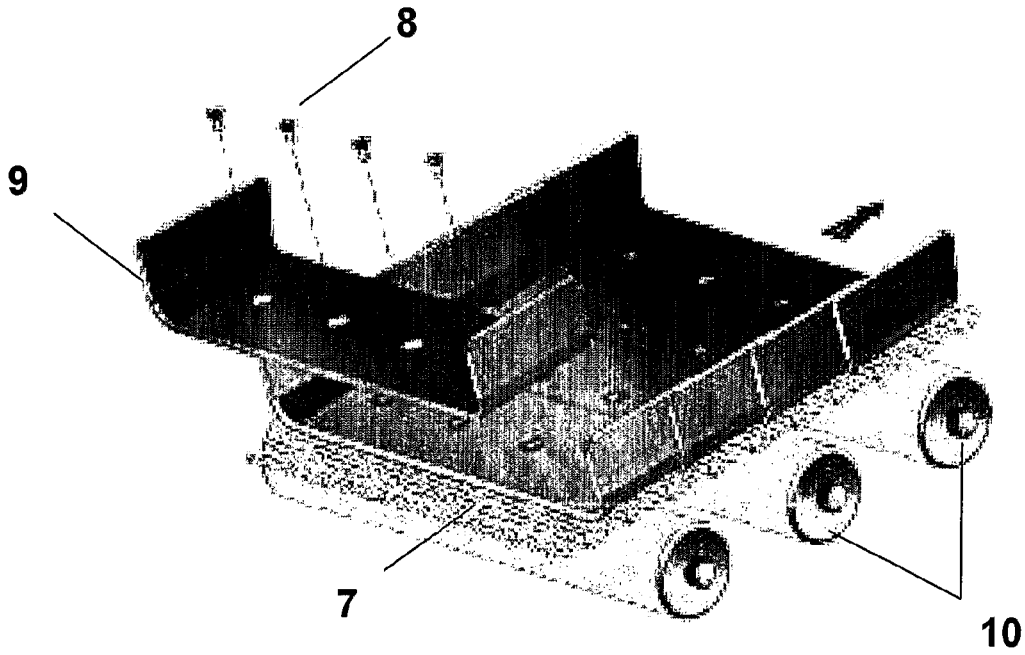
Figure 3:
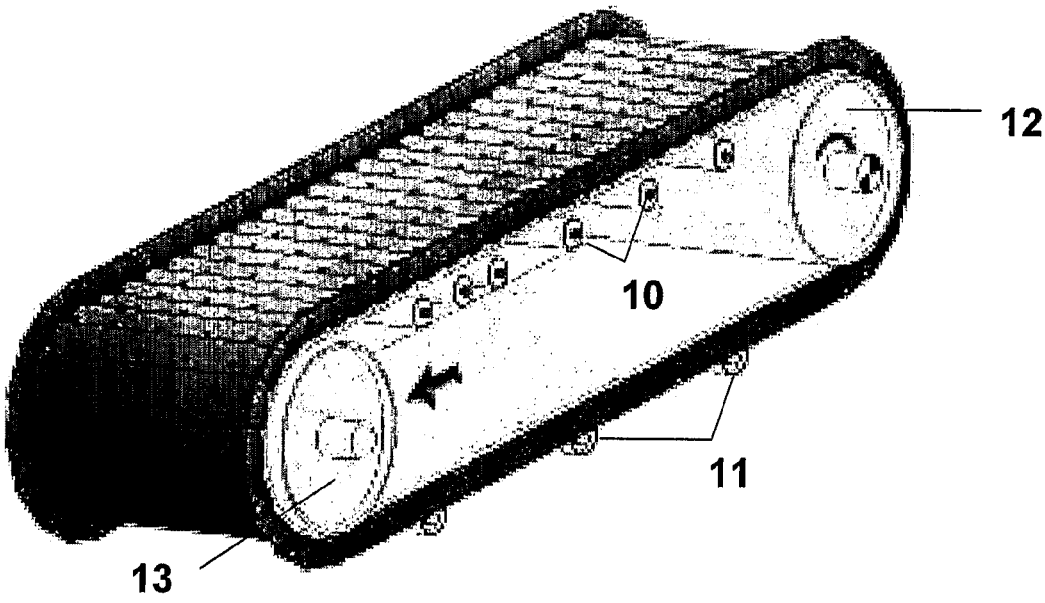
Figure 4:
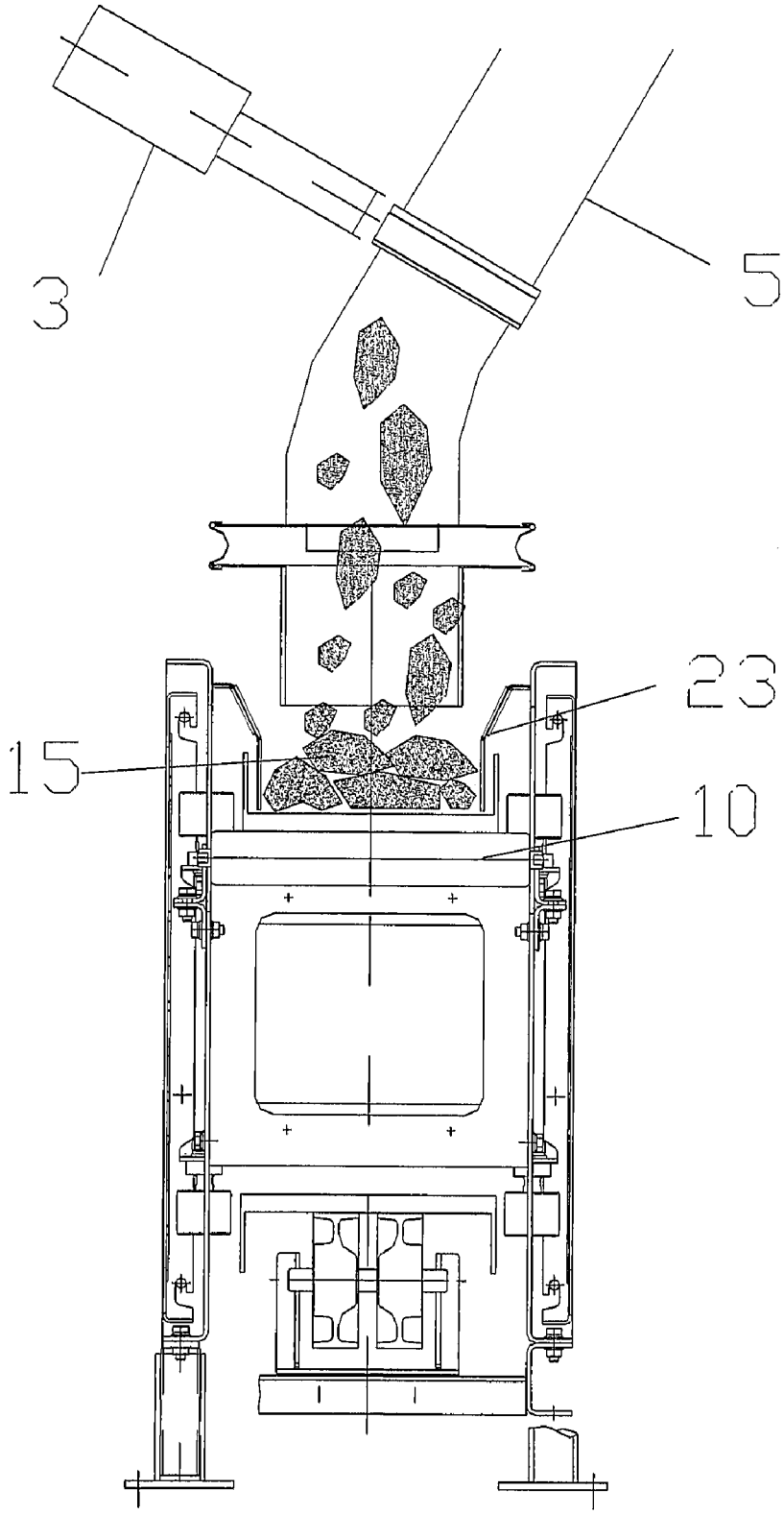
FIG. 4 is a schematic view of the cross section of the conveyor assembly in case of not completely closed machine ("a" configuration)
Figure 5:
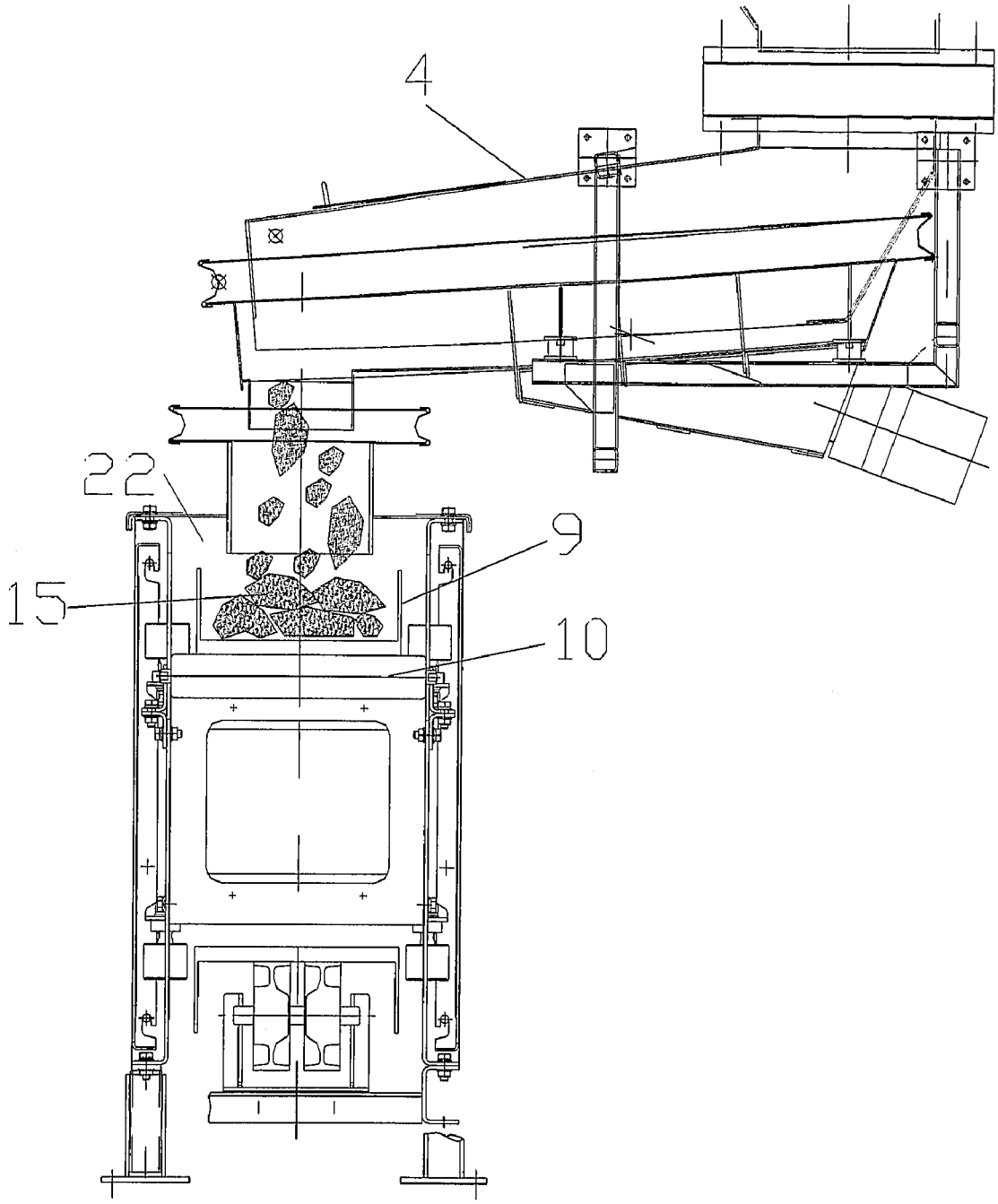
FIG. 5 is a schematic view of the cross section of the conveyor assembly in case of completely closed machine ("b" configuration)

Subsequently, the material 15 is conveyed to the predetermined stockage area 16, and this operation can be performed with a mechanical (FIG. 1) or a mechanical and pneumatic (FIG. 1*b*) conveyor.

In case of mechanical and pneumatic conveyor, an iron removal system 25, to eliminate the ferrous material present in the pyrites mixture 15, and a grinding system 25, to reduce the material size in order to make it suitable for being pneumatically conveyed, are provided downstream the metal conveyor 6.

In "a" configuration, the metal belt is provided with restraining side boards 23, to avoid the dust dispersion in the environment. In this configuration, in order to put out any combustion of the coal dust conveyed on the metal belt 6 together with the pyrites 15, temperature control sensors 19 are installed into the metal container 1, controlling a putting out system consisting of water injection nozzles 17.

To discharge the putting out water, the conveyor bottom can be provided with openings beneath which a proper collecting channel is disposed.

In "b" configuration, the admission of inert gas or steam in the metal container 1 through proper injection gates 18, driven by properly positioned sensors 19, is provided for putting out the combustion.

The inertization with inert gas or steam is also provided for the storage tanks 2 and the stockage silo 16 in any plant configuration.

In "b" configuration, the metal container 1 is provided with proper safety doors 20, with automatic opening in case of explosion, in order to assure the structure protection from the pressure increase due to an explosion.

In particular embodiments of the conveyor plant, the metal belt conveyor 6 can be provided with a recovery system 24 of the fines from the metal conveyor bottom. Such recovery system 24 is positioned in the area underlying the return stretch of the metal conveyor belt 6 and it can be provided with water nozzles 17.

The water used during the putting out phase can be conveyed by the same recovery system to the collecting channel.

It is evident that several modifications, adjustments, additions, variations and replacements of elements with functionally equivalent others could be made to the embodiments described hereinbefore with illustrative and not limiting purpose, without falling outside the scope of protection defined in the appended claims.

The invention claimed is:

1. A conveyor plant comprising a set of storage tanks (2), a conveyor for receiving and safely handling pyrites, coal dust and other foreign materials (15) coming from mills for the pulverization of solid fossil fuel and held in said set of storage tanks (2), one for each mill, an enclosed or open metal container (1) for said conveyor, inside which a high temperature resistant metal conveyor belt (6) not allowing the propagation of any fire is disposed, and a stockage silo (16) downstream from said conveyor, the storage tanks (2), said metal container (1) and the stockage silo (16) being provided with a combustion detection sensor system (19) which controls the admission of inert gas or water onto said pyrites, coal dust and other foreign materials according to plant configuration and the conveyance of the pyrites, coal dust and other foreign materials (15) to the stockage silo (16) being performed by an exclusively mechanical conveyor or by a mechanical and pneumatic conveyor, upon elimination of ferrous material through an iron removal system (25) and size reduction through a grinding system (26) when a pneumatic conveyor is present.

2. The conveyor plant according to claim 1, characterized by a fire prevention system provided with water nozzles (17) actuated by sensors (19), in case the metal container (1) is open, or with inert gas or steam admission nozzles (18), in case the metal container (1) is closed.

3. The conveyor plant according to claim 2, characterized in that it is provided with restraining side boards (23) for the material along the entire length of the conveyor, in order to reduce dust dispersion in the surrounding environment.

4. The conveyor plant according to claim 1, characterized in that a fines recovery system (24) is provided inside the metal container (1), in order to keep clean the bottom of the metal container (1) from deposited material dust and convey the deposited material dust to an unloading area.

5. The conveyor plant according to claim 4, characterized in that the fines recovery system (24) is provided with water nozzles (17) actuated by sensors (19), in order to put out any combustion of the dust.

* * * * *